US006301920B2

(12) United States Patent
Matsuda et al.

(10) Patent No.: US 6,301,920 B2
(45) Date of Patent: Oct. 16, 2001

(54) METHOD AND SYSTEM FOR COOLING STRIP MATERIAL

(75) Inventors: Naohiko Matsuda; Takanori Nagai, both of Hiroshima; Kwang-Hee Han; Jae-Young Lee, both of Tokyo, all of (JP); Joo-Seung Lee, Kwangyang (KR)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/728,079

(22) Filed: Dec. 4, 2000

Related U.S. Application Data

(62) Division of application No. 09/205,372, filed on Dec. 4, 1998.

(30) Foreign Application Priority Data

Dec. 5, 1997 (JP) ..... 9-335235

(51) Int. Cl.[7] ..... F25D 17/02
(52) U.S. Cl. ..... 62/374; 266/113
(58) Field of Search ..... 62/63, 64, 65, 62/373, 374, 375; 266/113

(56) References Cited

U.S. PATENT DOCUMENTS

| | | | | |
|---|---|---|---|---|
| 3,068,586 | * | 12/1962 | Vaughan et al. | 62/63 |
| 3,659,428 | * | 5/1972 | Kunioka et al. | 62/64 |
| 3,693,352 | * | 9/1972 | Hinze et al. | 62/64 |
| 4,330,112 | | 5/1982 | Toshimitsu et al. . | |
| 4,417,720 | | 11/1983 | Paulus . | |
| 4,497,180 | * | 2/1985 | Graham | 62/64 |
| 4,899,547 | * | 2/1990 | Irwin | 62/63 |

FOREIGN PATENT DOCUMENTS

| | | |
|---|---|---|
| 873060A | 6/1979 | (BE) . |
| 892795A | 8/1982 | (BE) . |
| 0049729A | 4/1982 | (EP) . |
| 0111985A | 6/1984 | (EP) . |
| 1151265A | 5/1969 | (GB) . |
| 62263818A | 11/1987 | (JP) . |
| 947371 B1 | 8/1994 | (KR) . |

OTHER PUBLICATIONS

Patent Abstracts of Japan, vol. 003, No. 083, Jul. 18, 1979—abstract for JP 54–058609A, published May 11, 1979.

Patent Abstracts of Japan, vol. 005, No. 152 Sep. 25, 1981—abstract for JP 56–084456A, published Jul. 9, 1981.

Patent Abstracts of Japan, vol. 006, No. 214, Oct. 27, 1982—abstract for JP 57–120623A, published Jul. 27, 1982.

* cited by examiner

*Primary Examiner*—Ronald Capossela

(57) ABSTRACT

A method and a system for cooling a steel strip are disclosed. A high water volume mist cooler and a low water volume mist cooler are disposed along a direction in which the steel strip travels. The high water volume mist cooler sprays high water volume mists onto the surfaces of the steel strip to cool the steel strip, and then the low water volume mist cooler sprays low water volume mists onto the surfaces of the steel strip to cool the steel strip, thereby cooling the steel strip while suppressing the influence of transition boiling, to prevent the steel strip from having a temperature-nonuniform portion.

6 Claims, 3 Drawing Sheets

METHOD AND SYSTEM FOR COOLING STRIP MATERIAL

This application is a divisional of co-pending application Ser. No. 09/205,372, filed on Dec. 4, 1998, the entire contents of which are hereby incorporated by reference.

FIELD OF THE INVENTION

The present invention relates to a method and a system for cooling a high temperature strip material in two steps.

BACKGROUND OF THE INVENTION

As an example of equipment with a system for cooling a high temperature strip material, a hot dip galvanizing system is shown in FIG. 3. This system comprises a hot dip galvanizing tank 60, a heater 71, a soaking device 72, and amist cooler 80 as a cooling device.

According to the above system, a steel strip 50 is galvanized in the hot dip galvanizing tank 60, moved vertically upward, and heated with the heater 71 to alloy the zinc with the steel. The alloyed steel strip 50 is soaked over its entire width by means of the soaking device 72. This steel strip 50 traveling in a cooling zone C is cooled with the mist cooler 80 from 520° C. to 200° C., and carried horizontally by a deflector roll 90.

The mist cooler 80 is composed of mist sprayers 81 disposed in opposing positions at both sides of the ascending steel strip 50. Each mist sprayer 81 comprises water supply pipes 82 and air supply pipes 83 arranged vertically in rows such that each air supply pipe 83 is mounted inside each water supply pipe 82 in a double-pipe configuration. Each water supply pipe 82 has many nozzle holes made along the width of the steel strip 50, and each air supply pipe 83 has many nozzle holes made along the width of the steel strip 50. The mist cooler 80 forms mists 86 from water 84 in the water supply pipes 82 by jetting air 85 through the nozzles of the air supply pipes 83, and directs the mists 86 toward the surfaces of the steel strip 50 to cool it.

With the foregoing mist cooler 80, mists 86 with a constant water volume density were sprayed on both sides of the steel strip 50 throughout the cooling zone C to cool the steel strip 50. At a site in the cooling zone C where the temperature of the steel strip 50 was about 350° C. or lower (i.e., an upper portion of the cooling zone C), however, the mists 86 adhering to the surfaces of the steel strip 50 underwent transition boiling, rapidly cooling the steel strip 50. Transition boiling refers, in terms of water, to a phenomenon involving transition from a state of cooling with water vapor to a state of direct cooling with water, or to a state of cooling with a mixture of water and water vapor. This phenomenon takes place at about 350° C. Thus, non-uniform temperature distribution of the steel strip 50 was liable to occur, thereby deforming the steel strip 50, resulting in its malformation.

SUMMARY OF THE INVENTION

The present invention has been accomplished to solve the above-described problems.

According to a first aspect of the present invention, there is provided a method for cooling a strip material, comprising:

passing the strip material, which is traveling, through a high temperature cooling zone and a low temperature cooling zone in this order, to cool the strip material with a high water volume air-water mixture in the high temperature cooling zone, and then cool the strip material with a low water volume air-water mixture in the low temperature cooling zone.

According to a second aspect of the present invention, there is provided a method for cooling a strip material, comprising:

passing the strip material, which is traveling, through a high temperature cooling zone and a low temperature cooling zone in this order, to cool the strip material with a high water volume air-water mixture in the high temperature cooling zone to a temperature in the vicinity of a temperature at which transition boiling occurs, and then cool the strip material with a low water volume air-water mixture in the low temperature cooling zone while suppressing transition boiling.

The air-to-water ratio of the high water volume air-water mixture may be about 1500, and the air-to-water ratio of the low water volume air-water mixture may be about 5000.

The above method may further comprise:

cooling the strip material in the high temperature cooling zone to a temperature in the vicinity of a temperature at which transition boiling occurs; and cooling the strip material in the low temperature cooling zone to a predetermined temperature.

In the above method, the passing step may include the sub-steps of:

cooling the strip material to about 350° C. in the high temperature cooling zone, and cooling the strip material from about 350° C. to a predetermined temperature in the low temperature cooling zone.

According to a third aspect of the present invention, there is provided a system for cooling a strip material, comprising:

a high temperature cooling zone and a low temperature cooling zone established as cooling zones, in which the strip material is cooled with a high water volume air-water mixture in the high temperature cooling zone, and cooled with a low water volume air-water mixture in the low temperature cooling zone.

In this system, the air-to-water ratio of the high water volume air-water mixture may be about 1500, while the air-to-water ratio of the low water volume air-water mixture may be about 5000.

In the above system, the high temperature cooling zone may cool the strip material to about 350° C., while the low temperature cooling zone may cool the strip material from about 350° C. to a predetermined temperature.

According to a fourth aspect of the present invention, there is provided a system for cooling a traveling strip material, comprising:

a high temperature cooling zone and a low temperature cooling zone established along a direction in which the strip material travels;

a high water volume air-water mixture cooler installed in the high temperature cooling zone for cooling the strip material with a high water volume air-water mixture to a temperature in the vicinity of a temperature at which transition boiling occurs; and a low water volume air-water mixture cooler installed in the low temperature cooling zone for cooling the strip material with a low water volume air-water mixture while suppressing transition boiling.

The high water volume air-water mixture cooler may spray high water volume mists onto both sides of the strip material, and the low water volume air-water mixture cooler may spray low water volume mists onto both sides of the strip material.

The high water volume air-water mixture cooler may include a multiplicity of spray pipes arranged vertically, each spray pipe having a water supply pipe for supplying a high water volume, and an air supply pipe mounted inside the water supply pipe, the water supply pipe extending in the direction of the width of the strip material and having a plurality of nozzle holes drilled facing a surface of the strip material, and the air supply pipe having a plurality of nozzle holes drilled in the direction of the width of the strip material. The low water volume air-water mixture cooler, an the other hand, may include a multiplicity of spray pipes arranged vertically, each spray pipe having a water supply pipe for supplying a low water volume, and an air supply pipe mounted inside the water supply pipe, the water supply pipe extending in the direction of the width of the strip material and having a plurality of nozzle holes drilled facing a surface of the strip material, and the air supply pipe having a plurality of nozzle holes drilled in the direction of the width of the strip material.

According to a fifth aspect of the present invention, there is provided a galvanizing system for galvanizing a strip material, comprising:

a hot dip galvanizing tank which galvanizes the strip material;

a heater that heats the galvanized strip material;

a soaking device that soaks the heated strip material;

a high temperature cooling zone which cools the soaked strip material by spraying a high water volume air-water mixture thereon; and a low temperature cooling zone which cools the soaked strip material, after cooling in the high temperature cooling zone, by spraying a low water volume air-water mixture thereon.

The hot dip galvanizing tank may contain molten zinc.

The present invention described above is carried out, for example, as a cooling system in hot dip galvanizing equipment. That is, this invention is applied in cooling a steel strip that has passed through a heater and a soaking device after undergoing hot dip galvanization. When the invention is applied as a cooling system in hot dip galvanizing equipment, the steel strip after hot dip galvanization is cooled with a high water volume air-water mixture (high water volume mists) in the high temperature cooling zone, and then cooled with a low water volume air-water mixture (low water volume mists) in the low temperature cooling zone. As a result of this two-step cooling, the temperature at which transition boiling occurs is lowered. Since the steel strip is not rapidly cooled, its temperature distribution becomes uniform. Thus, malformation of the steel strip due to thermal deformation does not occur.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

PREFERRED EMBODIMENTS OF THE INVENTION

Figure 1:
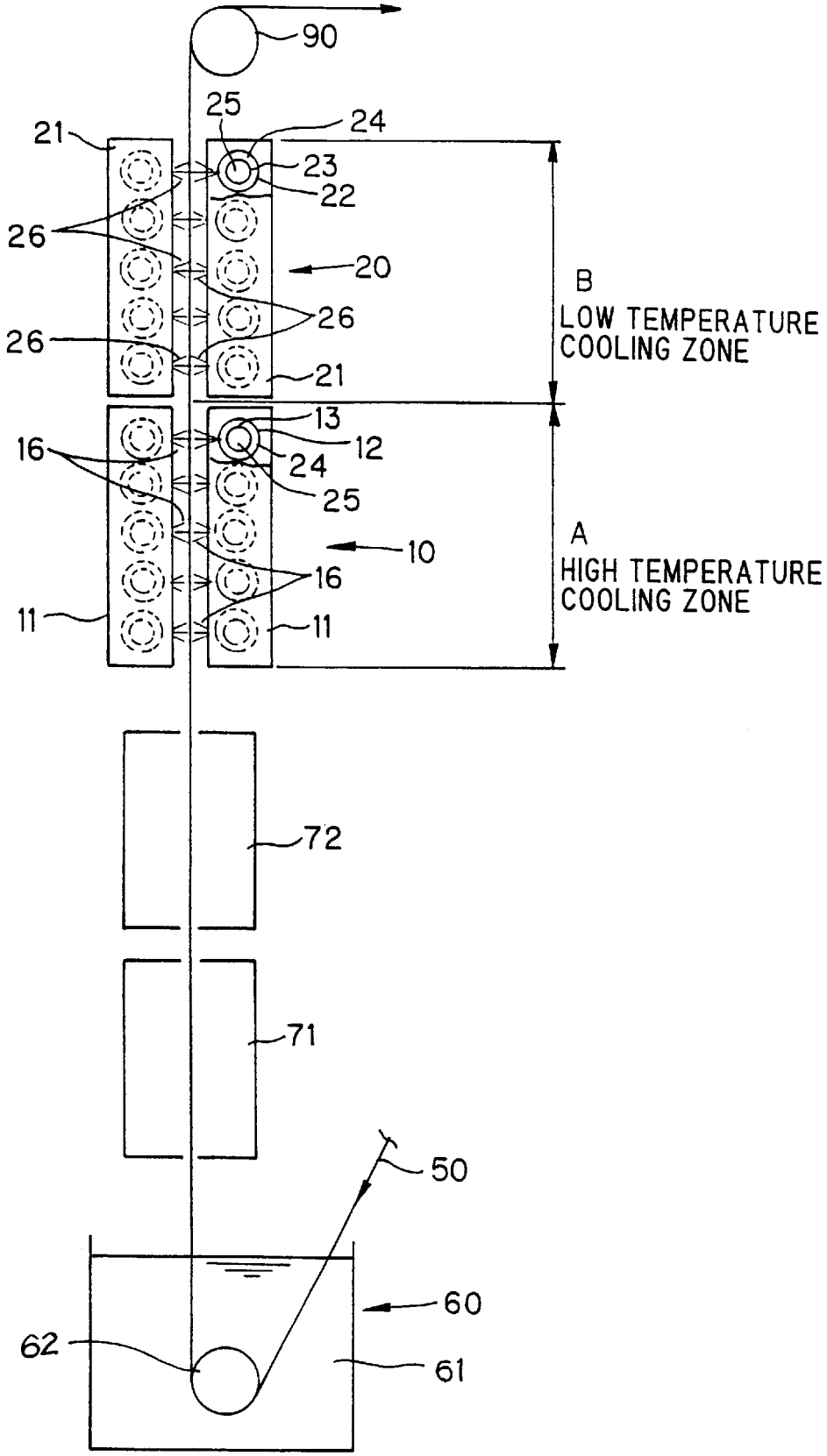
FIG. 1 is a schematic side view of a hot dip galvanizing apparatus with a strip material cooling system according to an embodiment of the present invention.

FIG. 1 is a schematic side view of a cooling system according to an embodiment of the present invention, in which the invention is applied to the cooling of a hot dip galvanized steel strip.

In FIG. 1, the reference numeral 60 denotes a hot dip galvanizing tank containing molten zinc 61. In the hot dip galvanizing tank 60, a deflector roll 62, over which a steel strip 50 is passed, is disposed. Above the hot dip galvanizing tank 60, a heater 71 is disposed. Above the heater 71, a soaking device 72 is disposed. Above the soaking device 72, a cooling zone is established. This cooling zone comprises a high temperature cooling zone A, and a low temperature cooling zone B located downstream of (or above) the high temperature cooling zone A. In the high temperature cooling zone A, a high water volume mist cooler 10 is installed as a high water volume air-water mixture cooler. In the low temperature cooling zone B, a low water volume mist cooler 20 is installed as a low water volume air-water mixture cooler.

The high water volume mist cooler 10 comprises high water volume mist sprayers 11 disposed on both sides of a path for the movement of the steel strip 50. Inside the high water volume mist sprayer 11, many water supply pipes 12 perforated with many nozzle holes in the direction of the width of the steel strip 50 are provided vertically in a row. Inside each water supply pipe 12, an air supply pipe 13 perforated with many nozzle holes in the direction of the width of the steel strip 50 is mounted in a double-pipe configuration. The water supply pipes 12 are connected to a water supply source (not shown). The air supply pipes 13 are connected to an air supply source (not shown).

The low water volume mist cooler 20 comprises low water volume mist sprayers 21 disposed on both sides of the path for the movement of the steel strip 50. Inside the low water volume mist sprayer 21, many water supply pipes 22 perforated with many nozzle holes in the direction of the width of the steel strip 50 are provided vertically in a row. Inside each water supply pipe 22, an air supply pipe 23 perforated with many nozzle holes in the direction of the width of the steel strip 50 is mounted in a double-pipe configuration. The water supply pipes 22 are connected to a water supply source (not shown). The air supply pipes 23 are connected to an air supply source (not shown).

On the exit side of (or above) the low water volume mist cooler 20, a deflector roll 90 for guiding the steel strip 50 is disposed.

The steel strip 50 is passed through the molten zinc in the hot dip galvanizing tank 60, whereby it is hot dip galvanized. The hot dip galvanized steel strip 50 is moved vertically upward, and passed through the heater 71. Upon heating the steel strip 50 in the heater 71, zinc and steel are alloyed. Then, the alloyed steel strip 50 is guided into the soaking device 72, whereby it is soaked over its entire width.

The steel strip 50 that has passed through the soaking device 72 enters the high water volume mist cooler 10 in the high temperature cooling zone A. In this zone, high water volume mists 16 are sprayed on the surfaces of the steel strip 50 by the high water volume mist sprayers 11. In detail, water 24 in a high water volume is fed to the water supply pipes 12, while compressed air 25 is fed to the air supply pipes 13. Air is jetted through the nozzle holes of the air supply pipes 13, whereby water 24 in the water supply pipes 12 is turned into the high water volume mists 16 and sprayed onto the surfaces of the steel strip 50 through the nozzle holes of the water supply pipes 12. By the action of the high water volume mists 16, the steel strip 50 is cooled from 520° C. to about 350° C. In the high temperature cooling zone A, as noted from this, the steel strip 50 is cooled, at a high cooling rate using a low air/water ratio, i.e., high water volume mists, to a temperature in the vicinity of the temperature of transition boiling. In the present embodiment, about 350° C. is cited as such a temperature to which the steel strip is cooled to. Needless to say, however, the steel strip may be cooled to a temperature close to about 350° C.

The steel strip 50 that has left the high water volume mist cooler 10 enters the low water volume mist cooler 20 provided in the low temperature cooling zone B. In this zone, low water volume mists 26 are sprayed on the surfaces of the steel strip 50 by the low water volume mist sprayers 21. In detail, water 24 in a low water volume is fed to the water supply pipes 22, while compressed air 25 is fed to the air supply pipes 23. Air 25 is jetted through the nozzle holes of the air supply pipes 23, whereby water 24 in the water supply pipes 22 is turned into the low water volume mists 26 and sprayed onto the surfaces of the steel strip 50 through the nozzle holes of the water supply pipes 22. By the action of the low water volume mists 26, the steel strip 50 is cooled from abut 350° C. to a temperature required before a subsequent step is performed, for instance, 200° C. As noted from this, the steel strip 50 is cooled in the low temperature cooling zone B, with the transition boiling phenomenon being suppressed.

The steel strip 50 that has left the low water volume mist cooler 20 is carried in a horizontal direction by a deflector roll 90.

Figure 2:
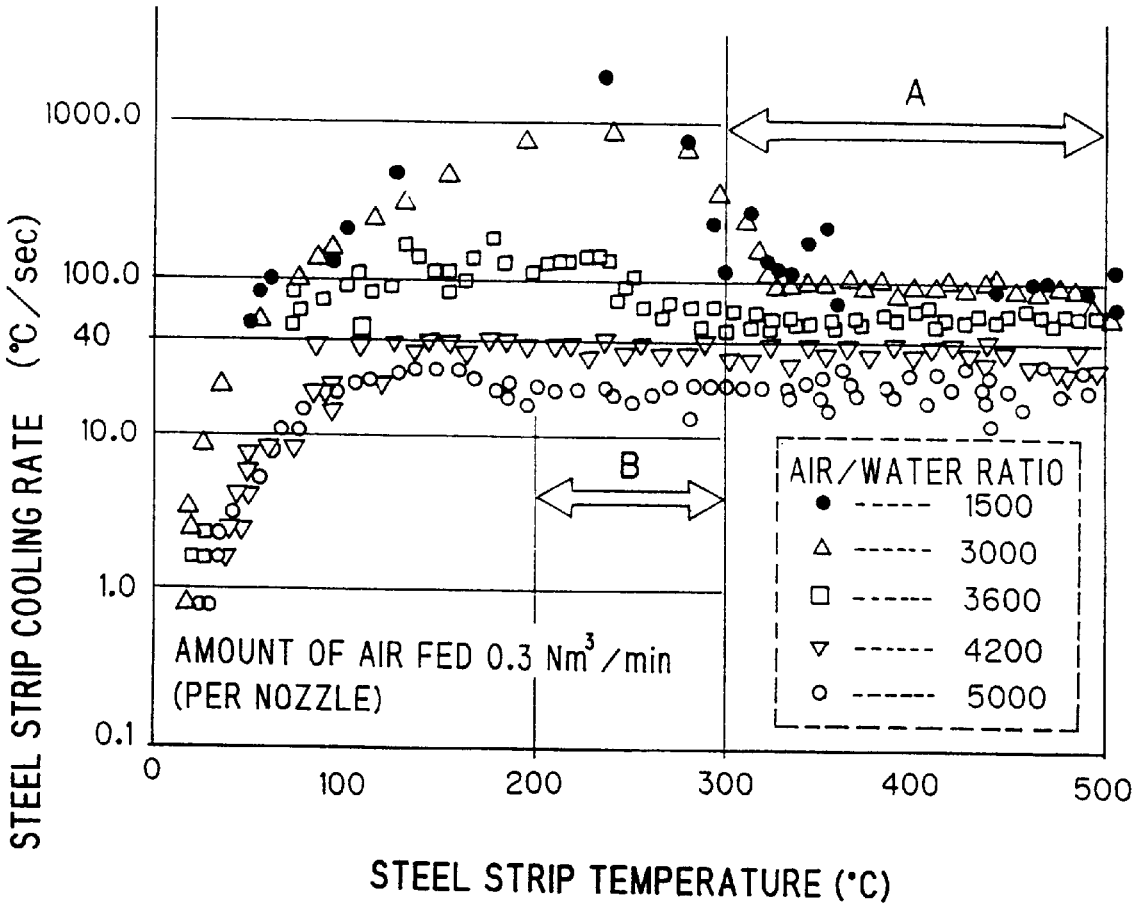
FIG. 2 is a diagram showing a steel strip cooling rate versus the temperature of a steel strip and the amount of water supply for mists.
Figure 3:
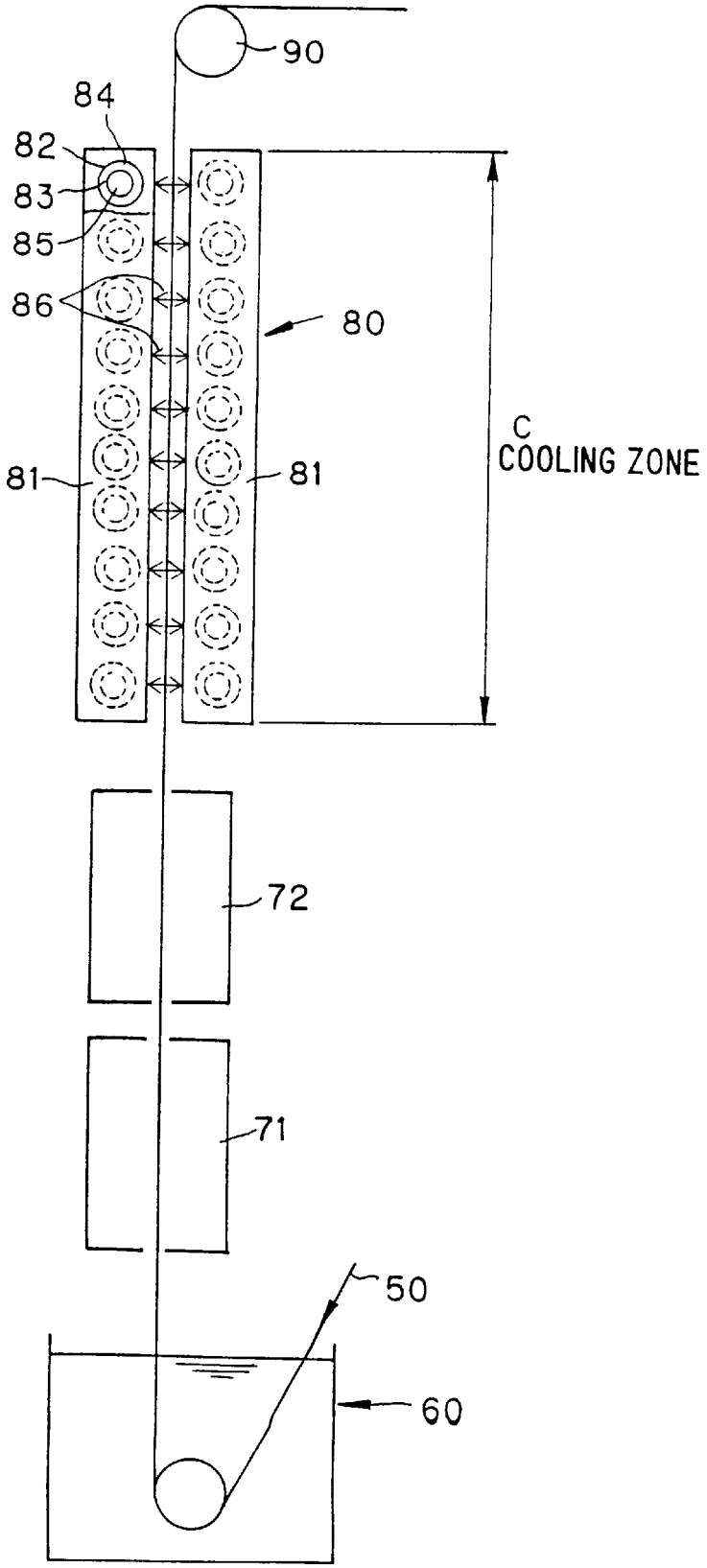
FIG. 3 PRIOR ART
FIG. 3 is a schematic side view of a conventional hot dip galvanizing apparatus.

FIG. 2 shows the results of experiments on the cooling rate of the steel strip 50 according to changes in the temperature of the steel strip 50 and the amount of water fed. The amount of air fed per nozzle of the water supply pipe was set at a constant value of 0.3 $Nm^3$/min, and the air/water ratio was set at varying values of 1500, 3000, 3600, 4200 and 5000. Under these conditions, the cooling rate of the steel strip 50 at varying temperatures was measured. In FIG. 2, it appears that ● and Δ represent the transition boiling phenomenon, while □, ▽ and ○ represent the absence of this phenomenon. This is because high air/water ratios corresponding to these symbols result in a low frequency of direct contact between water and the steel strip, thereby suppressing the transition boiling phenomenon.

Even when the amount of air fed and the amount of water fed are increased, the same tendency as shown in FIG. 2 is exhibited at the same air/water ratio. That is, when the amount of water fed is increased, the cooling rate for □ (air/water ratio: 3,600), ▽ (air/water ratio: 4,200) or ○ (air/water ratio: 5,000) is raised. However, there is no surge at a temperature of about 350° C.

Based on these results of experiments, the optimum amount of water to be fed was determined such that the air/water ratio would be 1500 in the high temperature cooling zone A, and 5000 in the low temperature cooling zone B. By setting the air/water ratio at 1500 for the high temperature cooling zone A, the steel strip 50 can be cooled at a high rate.

TABLE 1

Appropriate water volumes in high temperature cooling zone and low temperature cooling zone

| cooling portion | Amount of air fed ($Nm^3$/min) | Air/water ratio | Steel strip temperature (° C.) |
|---|---|---|---|
| High temperature cooling zone (A portion) | 0.3 | 1500 | 520 → 350 |
| Low temperature cooling zone (B portion) | | 5000 | 350 → 200 |

As the air-water mixture in the present embodiment, a fog with a small water particle size may be used in place of the high water volume mist 16 and the low water volume mist 26. That is, "mist" also means a fog with a small water particle size.

According to the present embodiment, the steel strip 50 traveling in the high temperature cooling zone A is cooled from 520° C. to 300° C. with the high water volume mist 16 as an air/water mixture, whereafter the steel strip 50 traveling in the low temperature cooling zone B is cooled from 300° C. to 200° C. with the low water volume mist 26. Thus, the steel strip temperature at which water in the mist 26 sprayed on the steel strip 50 traveling in the low temperature cooling zone undergoes transition boiling on the surface of the steel strip 50 can be lowered to 200° C. hence, the temperature distribution of th e steel strip 50 can be made uniform, and malformation of the steel strip can be prevented.

The embodiment described above shows the present invention as being applied to the cooling of a steel strip after hot dip galvanization. However, the present invention is not limited thereto, and can be applied generally to the cooling of a high temperature strip material.

According to the method for cooling a strip material as the first aspect of the present invention, the strip material, which is traveling, is passed through a high temperature cooling zone and a low temperature cooling zone, in this order, to cool the strip material with a high water volume air-water mixture in the high temperature cooling zone, and then cool the strip material with a low water volume air-water mixture in the low temperature cooling zone. Thus, the strip material can be cooled with the influence of transition boiling being suppressed, and malformation of the strip material can be prevented.

According to the method for cooling a strip material as the second aspect of the present invention, the strip material, which is traveling, is passed through a high temperature cooling zone and a low temperature cooling zone, in this order, to cool the strip material with a high water volume air-water mixture in the high temperature cooling zone to a temperature in the vicinity of a temperature at which transition boiling occurs, and then cool the strip material with a low water volume air-water mixture in the low temperature cooling zone while suppressing transition boiling. Thus, malformation of the strip material can be prevented.

According to the system for cooling a strip material as the third aspect of the invention, a high temperature cooling zone and a low temperature cooling zone are established as cooling zones, in which the strip material is cooled with a high water volume air-water mixture in the high temperature cooling zone, and cooled with a low water volume air-water mixture in the low temperature cooling zone. Since the strip material is thus cooled in two steps, it can be cooled with the influence of transition boiling being suppressed. Hence, the temperature distribution of the strip material can be made uniform, and malformation of the strip material can be prevented.

According to the system for cooling a traveling strip material as the fourth aspect of the invention, a high temperature cooling zone and a low temperature cooling zone are established along a direction in which the strip material travels; a high water volume air-water mixture cooler is installed in the high temperature cooling zone; and a low water volume air-water mixture cooler is installed in the low temperature cooling zone, whereby the strip material is cooled in two steps. Thus, the strip material can be cooled with the influence of transition boiling being suppressed. Thus, the temperature distribution of the strip material can be made uniform, and malformation of the strip material can be prevented.

In the system for cooling a strip material as the fourth aspect of the invention, the high water volume air-water mixture cooler sprays high water volume mists onto both sides of the strip material, and the low water volume air-water mixture cooler sprays low water volume mists onto both sides of the strip material. Because of this constitution, the strip material can be cooled efficiently with transition boiling being suppressed. Thus, the temperature distribution of the strip material can be made uniform, and malformation of the strip material can be prevented.

In the system for cooling a strip material as the fourth aspect of the invention, the high water volume air-water mixture cooler includes a multiplicity of spray pipes arranged vertically, each spray pipe having a water supply pipe for supplying a high water volume, and an air supply pipe mounted inside the water supply pipe, the water supply pipe extending in the direction of the width of the strip material and having a plurality of nozzle holes drilled facing a surface of the strip material, and the air supply pipe having a plurality of nozzle holes drilled in the direction of the width of the strip material; and the low water volume air-water mixture cooler includes a multiplicity of spray pipes arranged vertically, each spray pipe having a water supply pipe for supplying a low water volume, and an air supply pipe mounted inside the water supply pipe, the water supply pipe extending in the direction of the width of the strip material and having a plurality of nozzle holes drilled facing a surface of the strip material, and the air supply pipe having a plurality of nozzle holes drilled in the direction of the width of the strip material. Because of this constitution that cools the strip material in two steps, the strip material can be cooled with transition boiling being suppressed. Thus, the temperature distribution of the strip material can be made uniform, and malformation of the strip material can be prevented.

According to the galvanizing system as the fifth aspect of the invention, a galvanized strip material is cooled with a high water volume air-water mixture (high water volume mists) in a high temperature cooling zone to a temperature in the vicinity of a temperature at which transition boiling occurs, and the strip material is then cooled with a low water volume air-water mixture (low water volume mists) in a low temperature cooling zone, with transition boiling being suppressed. Because of these different modes of cooling, the strip material can be cooled with the influence of transition boiling being suppressed. Consequently, any nonuniform portion is not formed in the temperature distribution of the steel strip after galvanization. Thus, deformation of the steel strip due to a nonuniform temperature distribution is prevented.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A system for cooling a strip material, comprising:

a high temperature cooling zone having a first nozzle for spraying a high water volume air-water mixture towards the strip material to cool the strip material by the high water volume air-water mixture; and a low temperature cooling zone having a second nozzle for spraying a low water volume air-water mixture towards the strip material to cool the strip material by the low water volume air-water mixture after the strip material is cooled in the high temperature cooling zone.

2. The system of claim 1, wherein an air-to-water ratio of said high water volume air-water mixture is about 1500, and an air-to-water ratio of said low water volume air-water mixture is about 5000.

3. The system of claim 1, wherein said high temperature cooling zone cools the strip material to about 350° C., and said low temperature cooling zone cools the strip material from about 350° C. to a predetermined temperature.

4. A system for cooling a traveling strip material, comprising:

a high temperature cooling zone having a high water volume air-water mixture cooler for cooling the strip material with a high water volume air-water mixture to a temperature in the vicinity of a temperature at which transition boiling occurs; and a low temperature cooling zone having a low water volume air-water mixture cooler for cooling the strip material with a low water volume air-water mixture while suppressing transition boiling, wherein the high temperature cooling zone and the low temperature cooling zone are established along a direction in which the strip material travels.

5. The system for cooling a strip material according to claim 4, wherein:

the high water volume air-water mixture cooler includes first nozzles that spray high water volume mists onto both sides of the strip material, and the low water volume air-water mixture cooler includes second nozzles that spray low water volume mists onto both sides of the strip material.

6. The system for cooling a strip material according to claim 4, wherein:

the high water volume air-water mixture cooler includes a multiplicity of first spray pipes arranged vertically, each first spray pipe having a first water supply pipe for supplying a high water volume, and a first air supply pipe mounted inside the first water supply pipe, said first water supply pipe extending in the direction of the width of the strip material and having, a plurality of first nozzles facing a surface of the strip material, and said first air supply pipe having a plurality of second nozzles in the direction of the width of the strip material, and the low water volume air-water mixture cooler includes a multiplicity of second spray pipes arranged vertically, each second spray pipe having a second water supply pipe for supplying a low water volume, and a second air supply pipe mounted inside the second water supply pipe, said second water supply pipe extending in the direction of the width of the strip material and having a plurality of third nozzles facing a surface of the strip material, and said second air supply pipe having a plurality of fourth nozzles in the direction of the width of the strip material.

* * * * *